US011124339B2

(12) United States Patent
Georgiadis et al.

(10) Patent No.: US 11,124,339 B2
(45) Date of Patent: Sep. 21, 2021

(54) CONTAINER

(71) Applicant: Jokey Plastik Wipperfürth GmbH, Wipperfürth (DE)

(72) Inventors: Robert Guido Georgiadis, Overath (DE); Mike Löpprich, Marienheide (DE)

(73) Assignee: JOKEY PLASTIK WIPPERFURTH GMBH, Wipperfurth (DE)

( * ) Notice: Subject to any disclaimer, the term of this patent is extended or adjusted under 35 U.S.C. 154(b) by 61 days.

(21) Appl. No.: 15/740,420

(22) PCT Filed: Jun. 27, 2016

(86) PCT No.: PCT/EP2016/064834
§ 371 (c)(1),
(2) Date: Apr. 3, 2018

(87) PCT Pub. No.: WO2017/001329
PCT Pub. Date: Jan. 5, 2017

(65) Prior Publication Data

US 2019/0062009 A1 Feb. 28, 2019

(30) Foreign Application Priority Data

Jun. 29, 2015 (DE) ..... 20 2015 103 417.2
Aug. 5, 2015 (DE) ..... 20 2015 104 086.5

(51) Int. Cl.
*B65D 50/04* (2006.01)
*B65D 43/02* (2006.01)
*B65D 50/06* (2006.01)

(52) U.S. Cl.
CPC ..... *B65D 50/046* (2013.01); *B65D 43/0208* (2013.01); *B65D 43/0212* (2013.01);
(Continued)

(58) Field of Classification Search
CPC ..... B65D 2251/1025; B65D 50/046; B65D 43/0212; B65D 43/0208; B65D 50/06
(Continued)

(56) References Cited

U.S. PATENT DOCUMENTS 5,979,691 A * 11/1999 Von Holdt ..... B65D 43/0256 220/266
2008/0029527 A1* 2/2008 Woinarski ..... B65D 43/0256 220/782
2011/0024421 A1* 2/2011 Luburic ..... B65D 25/32 220/265

FOREIGN PATENT DOCUMENTS

DE 20215850 U1 2/2004
GB 2445109 A 6/2008
WO 2006021034 A2 3/2006

OTHER PUBLICATIONS

Int'l Search Report dated Aug. 30, 2016 in Int'l Application No. PCT/EP2016/064834.
(Continued)

*Primary Examiner* — Anthony D Stashick
*Assistant Examiner* — L Kmet
(74) *Attorney, Agent, or Firm* — Panitch Schwarze Belisario & Nadel LLP

(57) ABSTRACT

A container has an upper edge, a lateral wall extending around the circumference of the container, and an opening closed by a lid. A latching rim proximate the upper edge latches with a corresponding latching rim on the lid. The latching rims of the container and the lid, respectively, extend at least partially around a circumference of the same. The container lateral wall includes a peripheral skirt having a sub-region extending radially outwardly from the lateral wall. The lid includes a lower lid rim on the outside of the container and at least one extension extending outside the lateral wall of the container. The extension extends below
(Continued)

the lower rim of the lid and at least partially penetrates the skirt of the container. The extension and the container include corresponding fixing devices releasable independently of the latching devices formed by the latching rims of the container and the lid.

22 Claims, 7 Drawing Sheets

(52) U.S. Cl.
CPC ..... *B65D 43/0249* (2013.01); *B65D 50/06* (2013.01); *B65D 2215/02* (2013.01); *B65D 2215/04* (2013.01); *B65D 2215/08* (2013.01); *B65D 2401/10* (2020.05); *B65D 2543/0074* (2013.01); *B65D 2543/00092* (2013.01); *B65D 2543/00194* (2013.01); *B65D 2543/00296* (2013.01); *B65D 2543/00379* (2013.01); *B65D 2543/00407* (2013.01); *B65D 2543/00555* (2013.01); *B65D 2543/00629* (2013.01); *B65D 2543/00648* (2013.01); *B65D 2543/00685* (2013.01); *B65D 2543/00694* (2013.01); *B65D 2543/00759* (2013.01); *B65D 2543/00796* (2013.01); *B65D 2543/00805* (2013.01); *B65D 2543/00842* (2013.01)

(58) Field of Classification Search
USPC ..... 215/265
See application file for complete search history.

(56) References Cited

OTHER PUBLICATIONS

Written Opinion dated Aug. 30, 2016 in Int'l Application No. PCT/EP2016/064834.
Int'l Preliminary Report on Patentablility dated Jan. 2, 2018 in Appln PCT/EP2016/064834.

* cited by examiner

CONTAINER

CROSS-REFERENCE TO RELATED APPLICATIONS

This application is a Section 371 of International Application No. PCT/EP2016/064834, filed Jun. 27, 2016, which was published in the German language on Jan. 5, 2017, under International Publication No. WO 2017/001329 A1, which claims priority under 35 U.S.C. § 119(b) to German Application No. 20 2015 103 417.2, filed Jun. 29, 2015 and German Application No. 20 2015 104 086.5, filed Aug. 5, 2015, the disclosures of which are incorporated herein by reference in their entirety.

BACKGROUND OF THE INVENTION

The invention relates to a container with lid. The container has an upper container edge as well as a lateral wall extending around the full circumference of the container, and an upper container opening closed by the lid. In the region of the upper container edge, a latching rim is provided, for the latching connection with a corresponding latching rim provided on the lid. The latching rims of the container and the lid, respectively, extend at least around a partial circumference of the same. The lateral wall of the container further comprises a peripheral skirt having a sub-region that extends radially outwardly from the lateral wall, and the lid comprises a lower lid rim outside the container.

Containers of this type, provided with a latching lid, are variously known and must normally meet a number of requirements. Firstly, they must guarantee that the lid is securely seated on the container so that the container is securely sealed even if a certain external force is applied. Further, on the one hand, the lid shall be relatively easy to open for an intended user like an adult person whom the respective product is addressed to. On the other hand, these containers shall be difficult to open for unauthorized users like children for example, in particular small children, in order to protect the container content from unauthorized access and in order to protect particularly small children from the container content. Content hazardous for children are for example detergents, cleaning agents and disinfectants etc., but also the content of food containers not desired to be accessible to small children.

BRIEF SUMMARY OF THE INVENTION

The invention is based on the problem of providing a container with lid, which is relatively easy to open by an adult person while offering increased protection against access by children, especially small children.

This problem is solved by a container with a lid according to the claims. Advantageous embodiments are also apparent from the claims.

According to the invention, the lid comprises an extension that extends outside the lateral wall of the container and below the lower external rim of the lid and penetrates the peripheral skirt of the container at least partially or fully, wherein the extension and the container comprise corresponding fixing devices for fixing the extension to the container and which can be released independently of the latching device for fixing the container to the lid, hence independently of the latching engagement of the latching rim of the container with the corresponding latching rim of the lid. By this extension extending outside the lateral wall of the container and thus from the lid towards the bottom of the container, an additional structure of the lid is provided which a small children does not readily perceive as a device for opening the container. Within the scope of the present invention, said extension generally extends preferably in a vertical direction and preferably not radially outside the skirt of the container. According to the invention, the extension further penetrates the peripheral skirt so that at least a part or preferably the whole extent of the extension in the circumferential direction of the container is surrounded on the radial outside thereof by a sub-region of the skirt. This only allows for a limited displacement of the extension, for example pivoting the extension when operated, due to the arrangement of the skirt radially on the outside. This makes it more difficult to operate or manipulate the extension, especially for children, because the extension must be operated in a targeted manner. However, it is necessary to operate the extension in order to release the corresponding fixing devices between the extension and the container so as to remove the lid as a whole from the container. Preferably, the latching devices of the container and the lid can be unlatched only during an ongoing unlatching operation of the fixing devices between the extension and the container, which requires a coordinated operation of the opening devices when the container is opened. If desired, a substantial access protection to safeguard children may already be achieved if the fixing devices between the extension and the container are released in a first step, and at the time of manually disengaging these fixing devices (e.g. by manually "releasing" the same), the latching devices between the container and the lid are unlatched in a second step subsequent to this first step. This requires a difficult and purposeful manipulation of the opening mechanism of the unit (i.e. the container with lid), which per se is a clear barrier for infants who may try to open the container. Preferably, the fixing devices between the at least one lid extension and the container are releasable by hand and hence without a tool. Particularly preferably, the fixing devices between the lid extension and the container can be again fixed to one another after the initial opening of the container, i.e. can be opened and closed several times, when configured for example as positive locking devices or, if desired, also as non-positive locking devices. This affords a higher degree of child safety until the content of the container is completely consumed. This is a particular advantage compared to conventional containers the content of which is easily accessible to children once the tamper-evident closure such as a tear tab is opened, for example by manipulating the lid not provided with additional safety means.

According to the present invention, an "independent" operation of the extension while simultaneously releasing the fixing device generally is when by releasing the fixing devices between the extension and the container the latching rims between the container and the lid are not disengaged automatically and without an additional movement component.

It will be understood that generally within the scope of the present invention, a "vertical direction" is a direction along the container main axis from the bottom to the container opening. Generally within the scope of the present invention, the term "above" is understood to mean facing the upper edge of the container, and the term "below" is understood to mean facing the bottom of the container.

Generally within the scope of the present invention, the "at least one lid extension" is also referred to simply as "lid extension". If several lid extensions are provided, for example two, the features concerning the lid extension shall also apply to at least one additional lid extension or to all of the lid extensions in accordance with the invention. Said several lid extensions can be identically constructed or also differently, for example concerning their length, the flexibility and the design of the fixing devices etc. It is also comprised that additional, differently designed lid extensions may be provided where necessary.

Preferably generally within the scope of the present invention, the "penetration of the skirt by the lid extension" that is given at least partially or fully, is understood to mean a penetration of the skirt in height by the respective extension.

Preferably, the skirt of the container at least comprises a substantially horizontal region molded to the lateral wall of the container on the outside thereof, and mostly also a sub-region, which substantially extends in the vertical direction and which may surround the container over the entire circumference thereof. The lid extension may penetrate the at least substantially horizontal region of the skirt at least partially or preferably fully. The at least substantially horizontal region of the skirt may be continuously formed around the full circumference of the container. The at least substantially horizontal region of the skirt may also include a slope toward the main axis of the container that is arranged perpendicular to the container opening. The at least substantially horizontal region of the skirt can be a peripheral skirt formed around the full circumference of the container. Alternatively or additionally, also a substantially vertical region of the skirt may be penetrated by the lid extension, wherein this skirt region may also include a slope toward the main axis of the container that is arranged perpendicular to the container opening. Preferably, a sub-region of the skirt, particularly one of the above-mentioned sub-regions, is arranged at the level of the lid extension radially outside with respect to the latter.

If the lid extension penetrates the skirt only partially, then preferably in such a manner that the fixing devices between the extension and the skirt can be released by a manual engagement, hence in such a manner that the extension penetrates or passes through the skirt a sufficient distance. Where appropriate, the skirt may also overlap the free end of the extension that faces away from the lid. Preferably, the free end of the extension protrudes from the lower edge of the skirt towards the bottom of the container, optionally after a tamper-evident closure such as a tamper-evident tab is removed.

Preferably, the fixing devices of the at least one lid extension are disposed on the container radially inside with respect to the radial outside of the skirt, or particularly preferably radially inside with respect to the radial inside of the skirt.

Preferably, the extension is designed so as to be deformable in a reversible manner so that the fixing devices between the extension and the container can be released under a reversible deformation of the extension, for example by a manual engagement. Preferably, the rim extension is displaceable radially outwards, particularly preferably while elastically reversibly deforming a part of the extension or a part of the lid adjacent the extension. The reversible deformation can take place especially in the form of a pivoting movement of the extension radially outwardly, particularly with a movement component in the direction towards the upper edge of the container.

Particularly preferably, the extension is permanently molded to the lid, even after releasing the fixing devices between the extension and the container. Preferably, the extension is molded to the lid in such a manner that after releasing the fixing devices between the extension and the container, the extension can be removed only under destruction of the lid. The extension may be generally formed in the manner of a tab.

Particularly preferably, the lid extension is at least partially or fully overlapped on the outside thereof by a tamper-evident closure arranged on the container or particularly on the skirt of the container, while the extension is accessible for being operated by removing or changing the position of the tamper-evident closure, for example by pivoting or displacing the same. The tamper-evident closure can be particularly designed in the manner of a tear tab known per se, which is molded to the skirt of the container by linkages to the skirt of the container that can be disrupted a manual force applied. The tamper-evident closure, for example in the form of a tab, can be linked to the container or the skirt by means of linkages, a part or all of these linkages being releasable or disruptable a manual force applied, in order to cause a displacement or removal of the tamper-evident closure and thus enable the access to the lid extension. The tamper-evident closure makes it more difficult to access the lid extension that must be manipulated for opening the container. This already provides a certain barrier for children to access the container. According to the invention it is, however, not sufficient to remove the tamper-evident closure in order to remove the lid from the container, but also the fixing devices between the lid extension and the container must be released, which creates a considerable barrier to releasing the lid. On the other hand, however, the lid extension is additionally protected optically and due to the required distance or displacement of the tamper-evident closure by the lid extension being overlapped by the tamper-evident closure. On the other hand, because the lid extension penetrates the skirt as described above, i.e. is preferably surrounded on the outside thereof by the skirt with a part or the full circumference thereof, a displacement of the extension is limited by the skirt even after the removal or displacement of the tamper-evident closure, which makes it extremely difficult, especially for small children, to detach the lid. The tamper-evident closure guarantees that an initial opening of the container is visible on the one side and that the container which is reclosed after it has been opened for the first time offers an increased protection against the access by children on the other side, due to the fixing devices of the lid extension and the container being operable several times, preferably in a reversible manner. Generally within the scope of the present invention, the tamper-evident closure can if necessary also be integrated in or co-operate with the lid extension, for example by a destroyable connection of the lid extension to the container or by a material connection of the lid extension and the container, e.g. by bonding or welding, in addition to the fixing devices already provided.

Preferably, after the removal or displacement of the tamper-evident closure, the skirt of the container forms a recess that is open towards the bottom of the container. This enables a manual engagement from the direction of the bottom of the container towards the upper side and into the open recess, in order to manipulate the lid extension for releasing the fixing devices between the extension and the container or generally for releasing the lid. Preferably, generally within the scope of the present invention, a displacement or change of position of the extension for releasing its fastening to the container is hindered or limited by the extension being overlapped by the tamper-evident closure. By the creation of the recess of the skirt which is open towards the bottom of the container as a result of removing or displacing the tamper-evident closure, a corresponding clearance for operating the extension is provided, while the extension still penetrates the skirt or is at least partially surrounded by the skirt on the outside thereof. Preferably, this configuration simultaneously causes that for manipulating the extension in order to detach the lid, an upper portion of the tamper-evident closure impedes or prevents the tamper-evident closure from being completely removed or has to be displaced a considerable distance in order to be able to operate the lid extension, particularly where the lid extension has to be pivoted outwardly and upwardly. On the other hand, the downwardly open recess of the skirt enables the displacement of the extension upwards and towards the upper edge of the container, preferably in combination with the given pivoted position of the extension, and thus the unlatching of the lid from the container, after the fixing devices of the extension are released.

Preferably, the skirt overlaps the tamper-evident closure on the upper side thereof so that the tamper-evident closure is protected against external forces applied, which is often the case when containers are arranged side-by-side, for example when the skirt of a first container is placed onto the skirt of another container from above.

Particularly preferably, the tamper-evident closure is radially inwardly offset from the skirt, which affords a particular protection of the skirt when various containers are arranged side-by-side so that the containers touch each other only laterally by the skirt.

Particularly preferably, the fixing devices of the lid extension engage the skirt. The fixing device can thus be formed in an easy manner and can have a stable design, because the skirt forms a stiffening of the lateral wall of the container.

Particularly preferably, the fixing devices between the lid extension and the container are configured as positive-locking devices or particularly as latching devices which therefore are easy to open, also several times in a reversible manner, hence also after the container is opened for the first time. Further, the fixing devices configured as latching devices supplement the latching devices formed by the latching rims of the container and the lid with respect to their extension over the periphery of the container, so that secure fixing of the lid over preferably the whole circumference of the container is given, particularly in a case where for instance the latching rims between the container and the lid are interrupted at the level of the lid extension or where the latching connection is weaker. Further, the container can be easily closed by attaching the lid and by exerting a vertical pressure for locking the lid to the container, which can also be performed automatically, whereby also the said fixing devices are engaged with each other. Where appropriate, the fixing devices between the lid extension and the container can also be configured in a different way, for example by a material connection or a non-positive connection between the lid extension and the container or the skirt.

According to a first alternative, the at least one lid extension may comprise a protrusion that co-operates with a corresponding protrusion of the container, in order to create the releasable positive-locking devices or latching devices for fixing the lid extension to the container. This construction is simple because the fixing region such as a protrusion or collar of the container need not be constructionally changed for this purpose and because it is sufficient for the extension to engage under the fixing region if necessary. Also, the fixing devices can be easily manually released. According to a further embodiment, which is particularly preferred, the extension or the container may include a recess that is engaged or penetrated by a protrusion of a respective one of the container and the lid extensions as a corresponding fixing device for detachably fixing the lid extension to the container. Preferably, the recess is configured as an aperture, whereby the engagement of the protrusion is better visible by the user and can be checked more easily. Further, this provides for an increased safety of the fixing device because the recess can be formed with relatively sharp-edged boundaries, which guarantees a particularly secure fixing of the protrusion in the recess even if a certain force is applied to the extension or to the lid. This additionally increases child-safety. The positive-locking or latching devices according to this modification can be preferably formed without undercuts, although an undercut may provided if necessary in the protrusion engaging the recess and/or also the recess or aperture according to this modification. The protrusion of the container can be provided on a collar of the container that can be configured for instance in the manner described in the following. The recess, particularly in the form of an aperture, is preferably arranged on the lid extension, which makes it easier to optically detect the engagement of the protrusion. Where appropriate, the recess can also be provided at a container region, for example at a collar of the container to be described in the following.

Preferably, the lid extension has a radially protruding or bulging region arranged at the level of the skirt or particularly preferably below the skirt, for example below a radially inwardly directed re-entrant region of the skirt. If the extension is manipulated by hand, for example deflected outwards, the extension abuts the region of the skirt that is penetrated by the extension. As a result of the radially outwardly protruding or bulging region of the extension, the same will hook to the skirt, for example at the radially inwardly protruding region thereof or at the lower edge of the skirt. In this manner, the lid is prevented from an upward displacement and thus from the locking or latching rims of the lid and the container becoming unlocked. In this manner, an opening safety device is created that is particularly effective for infants. For releasing the lid, the extension must be manipulated, which is only possible by and necessarily requires a deflection of the extension from its initial position towards the skirt, at least by a partial amount of its possible deflection.

Preferably, the container has a protrusion molded to the outside of the container and overlapped by the lid, and the fixing devices of the lid extension, which detachably fix the lid extension to the container, engage at said protrusion. Preferably, the protrusion is configured as a collar. On the one side, the container is stabilized on the outside thereof by this collar. To this end, the collar may extend only over a part of the periphery of the lid, for example in the manner of a local protrusion. Preferably, the collar extends over more than one half of the circumference of the container or at least over substantially the entire circumference of the container and even more particularly over the entire circumference of the container, whereby the container is particularly stabilized. As a result of being overlapped by the lid, the collar and thus also the fixing device of the lid extension on the lid are protected against intrusion from outside and in a corresponding manner when a protrusion is arranged. Particularly preferably, the extension abuts the outside of the collar or protrusion, which prevents the fixing devices between the lid extension and the container or collar or protrusion from disengaging unintentionally under the influence of an external force, and which stabilizes the lid extension in its position fixed to the container. Alternatively or in combination therewith, the external lower region of the lid, for example the lower rim of the lid on the outside thereof, may abut the protrusion or particularly the collar on the outside thereof or may be spaced only little from the same, whereby the lid is stabilized, for example when an external force is applied to it, so that the collar or the protrusion can form an abutment for the lid.

Generally within the scope of the present invention, the extension preferably extends only around a part of the circumference of the container, particularly preferably around ≤¼ or ≤⅛ and even more preferably around ≤1/16 or ≤1/32 of the circumference of the container. The circumferential extent of the extension can be less than or equal to the width of a hand of an adult person, hence ≤10 cm for example, or less than or equal to the width of only a few fingers, hence ≤6 cm, so that the extension can be easily manipulated by fingers of the user engaging at the extension.

Preferably, the latching rim of the container and/or the lid at the level of the fixing device of the lid extension on the container is configured as a weakened latching connection. Particularly preferably, only one of the two latching rims of the container and the lid at the level of the lid extension on the container is configured as a weakened latching connection. The "weakened latching connection" respectively relates to the comparison with the regions of the latching rims of the lid and the container circumferentially spaced from the lid extension, for example the region of the lid diametrically opposite the lid extension. This enables the lid being detached and removed from the container relatively easily, despite the limited possible displacement of the lid extension due to its restriction by the skirt that is penetrated by the extension. It turned out when the invention was made that with this weakened latching connection, the limited possible change of the position or displacement of the lid extension is already sufficient for releasing the lid at the level of the extension also in the region of the latching connection between the lid and the container and for completely detaching the lid by continuing lifting the lid, for example by displacing the lid extension towards the upper edge of the container. The "weakened latching connection" is to be understood in a sense that the lid for being unlatched requires a smaller displacement or a reduced deformation of the lid in this region than in the region of the latching rims between the lid and the container spaced from the lid extension, in which region the regular latching connection between the lid and the container exists, in order to guarantee that the lid is seated on the container, even if an external force is applied. This weakening of the latching connection can be achieved for example by designing the respective latching rim with a lower thickness, in order to effect the described unlatching more easily. It turned out to be particularly advantageous if the latching rim of the container and/or the lid is interrupted at the level of the fixing device of the lid extension on the container, i.e. that the latching rim of the container and/or the lid at the level of the mentioned fixing device is missing. Here, the above-mentioned advantages regarding the weakened latching connection are achieved in a particular way. Preferably, only one of the two latching rims of the container and the lid is interrupted, for example the latching rim of the lid, and the respective other latching rim may continuously have a constant thickness and cross sectional shape around the circumference of the container, without being limited thereto, i.e. the respective other latching rim may also be configured as a "weakened latching rim". In this case, the respective lid and container components can be more easily molded and the corresponding tool more easily manufactured. Here and also generally within the scope of the present invention, the container and the lid can be formed as plastic parts, for example as injection-molded parts.

Particularly preferably, the latching rim of the container and/or the lid is arranged in a manner spaced in circumferential direction of the container from the at least one lid extension or the fixing device thereof. This is particularly the case with an interrupted latching rim of the container and/or the lid, as described above. To this end, the latching rim of the lid can be arranged for instance in a manner spaced from the lid extension in a circumferential direction. This further facilitates releasing the lid due to the limited changeability of the position of the lid extension. It has shown that even a small spacing is already effective. The thickness of the latching rim may continuously decrease in the end portion thereof. It turned out to be advantageous if the latching rim of the container and/or the lid is circumferentially spaced from the lid extension by an amount less than or equal to the width of the extension or ≤½ or ≤¼ of the width of the extension. The lid can still be easily detached, while the latching connection of the lid to the container is not substantially weakened, in order to make sure that the lid is securely seated on the container even if an external force is applied.

Preferably, the fixing devices on the lid extension and on the container are spaced from the latching rims of the lid and the container in relation to the height of the container, for fixing the latching rims to each other in a latching manner. In this manner, the fixing devices on the one hand and the latching rims of the lid and container on the other hand are spatially decoupled, which fact promotes an independent disengagement of the fixing devices between the extension and the container from the latching rims for fixing the lid to the container and increases child safety, i.e. makes the operation by infants much more difficult.

Preferably, the fixing devices between the lid extension and the container are arranged on the side of the latching rims of the lid and the container facing away from the upper edge of the container. This guarantees in a particular manner that the fixing devices between the extension and the container must be released in a first step and thereafter the latching rims of the lid and the container can be unlatched in a second step. This considerably increases the safety of the container.

Preferably, the latching rims of the lid and of the container are arranged between the collar and the upper edge of the container, for fixing the lid in a latching manner. Accordingly, the latching rims of the lid and of the container are arranged above the collar, for example in the region of or on the upper edge of the container. This provides for a particularly secure fixing of the lid to the container on the one hand and for a larger spatial decoupling of the latching devices for the fixation of the lid to the container from the fixing devices between the extension and the container on the other hand, whereby access security to the container is increased on the one hand and a stable and secure fixation of the lid to the container is guaranteed on the other hand.

Preferably, the lid comprises at least two extensions or precisely two extensions that respectively extend below the lower lid rim and are spaced from each other in the circumferential direction of the container. Reference is made to the above description with respect to each of the extensions and to the features of the container and/or the lid described in this context. The extensions respectively extend outside the lateral wall of the container and below the lower edge of the container, wherein two or more extensions respectively penetrate the peripheral skirt of the container. Each of the extensions penetrates the skirt of the container independently of the other extension(s) so that the skirt preferably has no penetration or is not interrupted between the extensions. At least two or each of the extensions comprise corresponding fixing devices to the container which can be released independently of one another. Further, the respective fixing devices between the individual extensions and the container can be respectively released independently of the latching devices formed by the latching rims of the container and the lid. By arranging two or possible more than two of these extensions, the prevention of the access by unauthorized persons like infants is considerably increased. Nevertheless, adult persons can still easily open the container.

Preferably, the lid has several extensions, for example two extensions, and the lid extensions are to be simultaneously manipulated for disengaging the lid from the container. In this manner, the container is configured particularly child-safe because opening the container requires a coordinated manipulation of several spatially separated extensions, which creates a considerable obstacle for children, particularly for small children.

According to another particularly preferred embodiment, the lid comprises several extensions, preferably two, and these extensions can be manipulated one after the other, for detaching the lid from the container. This makes it much more difficult for infants to open the container because of a number manipulation steps that must performed. For an adult person, it is comparatively easy to open the container because only one hand is needed for successively disengaging the individual extensions.

It will be understood that in the above-described variants of the container configuration in which several extensions must be simultaneously manipulated or optionally may be manipulated one after the other, the design of the container and particularly also the design of the extensions may be identical, wherein the respective variant may be obtained by adjusting the stiffness of the lid and/or the construction of the latching rims such as in particular the radial thickness thereof.

Preferably, the lateral wall of the container comprises regions having large and small (smaller) radii of curvature, and the containers can for example be configured as an oval-shaped container or as a rectangular container, including square containers, having rounded corner regions. At least one or more of the lid extensions are arranged at a region of the lateral wall having a small radius of curvature (i.e. generally the smaller radius in relation to the large radius). The lid extensions may be arranged in particular in the rounded corner regions of the container. In the case of an oval-shaped container, said one or more lid extensions can be arranged at or adjacent the regions of the lateral wall having the largest possible distance to each other and hence the largest extension of the container in relation to the width of the container. For example, said one or possibly also several lid extensions may be arranged at a region of the lateral wall having a medium radius of curvature. This facilitates easy opening the container because the lid extensions are arranged at regions of the container and hence the lid having an increased stiffness, whereby adjacent regions of the lid having a lower stiffness can be deformed more easily, in order to enable the lid being easily detached form the container.

Particularly preferably, at least two or precisely two lid extensions are provided that are arranged at adjacent regions of the container lateral wall having the small (smaller) radius of curvature, wherein between the lateral wall regions having a smaller radius of curvature there is preferably arranged a lateral wall region having a relatively larger radius of curvature. The lid extensions are thus arranged at regions of the container lateral wall or of the corresponding lid having an increased stiffness, with a region having a larger radius of curvature and hence a lower stiffness interposed therebetween. Particularly preferably, this is implemented in the case of rectangular containers, including square containers, and where appropriate also in oval-shaped containers. In this manner, a stable engagement of the lid extensions at the container and hence an increased child safety are given, while the lid can still be more easily unlatched from the container.

In a preferred embodiment, the lid is configured as a hinged lid where a part of the lid remains on the container when the lid is opened, while access to the interior of the container is enabled by the other part of the lid being flipped open. This embodiment is particularly advantageous, especially when two or more lid extensions with corresponding fixing devices relative to the container are provided. In this manner, the container offers an increased child safety and opening the lid of the container is made easier by the part of the lid that remains fixed in position on the container because the lid is fixed to the container with a part thereof so that the fixing devices between the extension and the container can be more easily disengaged, independently of unlatching the lid from the container. Especially when two or more lid extensions are arranged, it is possible to manipulate the lid extensions in a defined manner in order to detach the lid from the container by an engagement at the extensions.

Particularly preferably, the lid is sealingly applied against the inner wall of the container with an internal flange that passes into the inside of the lid. This provides for safe sealing also in the latching rim region of the container.

Preferably, the lid comprises a peripheral U-shaped channel receiving the upper edge of the container, the extension of the lid being molded to the flange being arranged on the outside of the channel. The lid is securely seated on and sealed against the container. Arranging the extension turned out to be particularly useful in lids of this type. If necessary, the lid may also have a planar inner lid surface for sealing the container opening, which planar inner surface extends radially to the edge of the container. But the lid may also be configured in a different way.

Preferably, the lid comprises a step-offset at the flange arranged on the outside and surrounding the container on the outside thereof, which step-offset is preferably arranged above the skirt and/or above the collar when the lid is attached. In this manner, the lid is stiffened and can be more easily opened while engaging at the extension.

Preferably, the lid comprises on the inner surface sealing the opening of the container and extending radially to the edge of the container several stiffening protrusions distributed over the circumference of the lid, which can be arranged on the upper side of the lid and/or on the lower side of the lid. The stiffening protrusions can be provided in the form of ribs or box-like protrusions or also in a different form. This stiffening makes it easier to open the container while unlatching the corresponding latching rims from the lid and the container by manipulating the lid extension.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
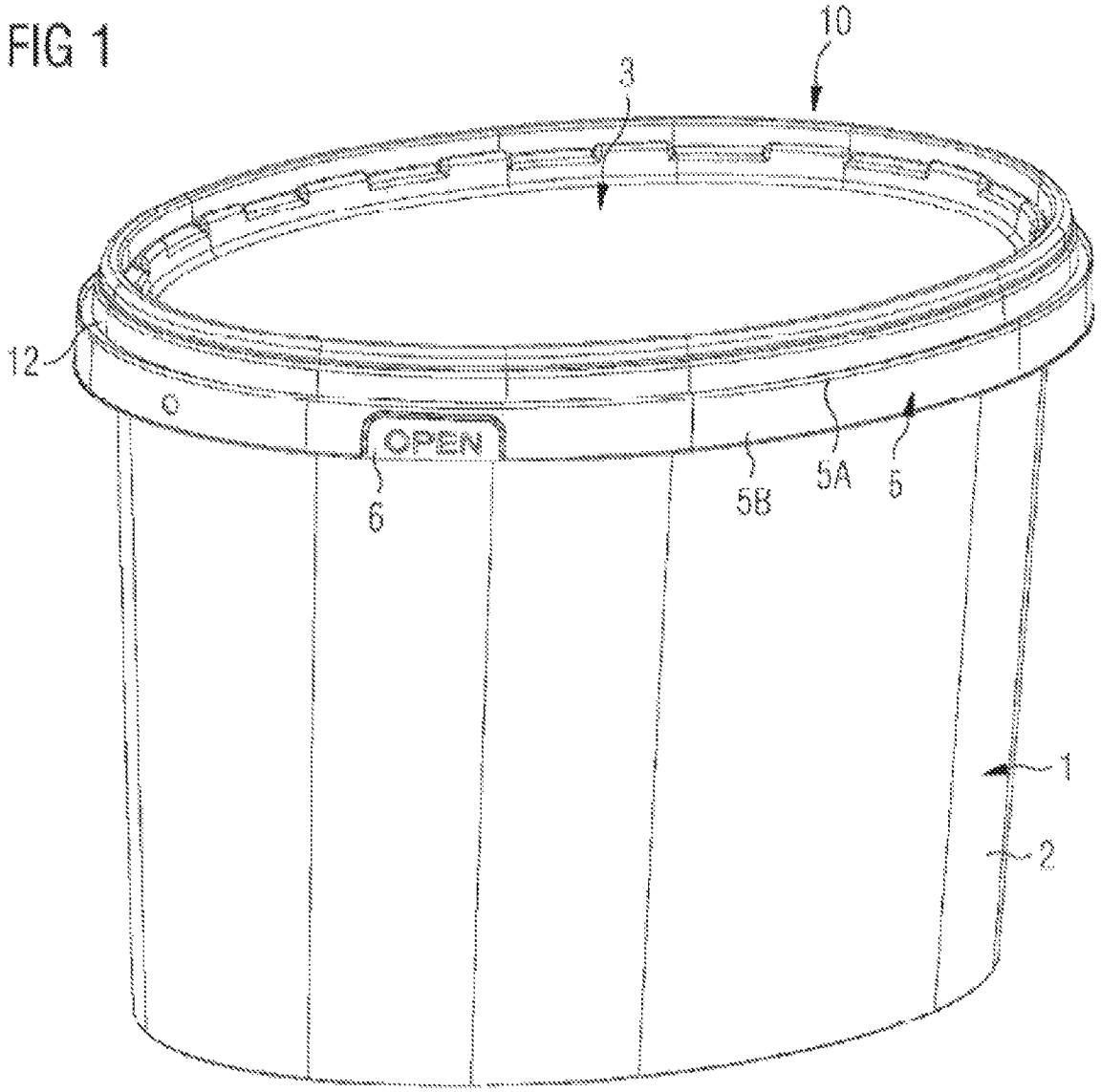
FIG. 1 is a perspective view of a first regular container having a tamper-evident closure.

FIG. 1 shows a container 1 according to the present invention in the form of an oval-shaped container with a lid 10. However, it should be noted that the embodiment is not limited to this type of container. The container 1 has an upper container edge 1A and a peripheral lateral wall 2 and a container opening 3 closed by said lid. In the region of the upper container edge 1A, a latching rim 4 is provided, for a latching connection to a corresponding latching rim 11 (shown by a dashed line) provided on the inner side of the lid 10. The lid is fixed to the container by the engagement of said two latching rims 4, 11 of the container and the lid. The latching rims 4, 11 of the container and the lid can be continuous around the container or lid, especially the latching rim 4 of the container. If necessary, the latching rims can be configured in a manner comprising a plurality of latching protrusions spaced from each other in the circumferential direction of the container, especially that of the lid. The lateral wall 2 of the container 1 has a peripheral skirt 5 that preferably extends around the full circumference of the container and radially outwardly from the container lateral wall 2. In the embodiment, the skirt comprises a substantially horizontal region 5A and a substantially vertical region 5B. The lid 10 has a lower rim 12 that terminates above or at the level of the skirt (shown by a dashed line in FIG. 3). The lid rim 12 is placed on the skirt 5 but preferably, it may be slightly vertically spaced from the skirt in the direction of the height along the longitudinal axis L of the container.

According to the invention, the lid 10 at least comprises one extension 13 extending outside the lateral wall 2 of the container 1 and below the lower lid rim 12 and penetrating the peripheral skirt 5. To this end, the skirt includes a passage opening 5C through which the extension 13 extends. The passage opening 5C is arranged in the substantially horizontally extending region 5A of the skirt, which is particularly advantageous for the implementation of the invention, without being limited thereto. The extension 13 and the container 1 comprise corresponding fixing devices 14 (FIG. 3) that can be released independently of the latching devices for fixing the container to the lid, hence independently of the latching rims 4 and 11. The fixing devices can be used several times after the container is opened for the first time, i.e. the fixing devices can be engaged with each other in a reversible manner, said engagement being automatically effected at the time of latching the lid to the container. Generally within the scope of the present invention, "fixing the lid to the container" is understood to mean in particular that the lid is supported on the container as intended and securely seals the container even if a certain external force is applied to the container. This is also given in a case where the fixing devices between the extension and the container are released or are missing in a reference container. The configuration according to the invention provides for an increased child safety of the container, while the container can still be relatively easily opened by a user and can also be easily closed, for instance in an automatic filling station, by simply attaching the lid to the container in a latching manner.

The container 1 further comprises a tamper-evident closure 6, which in the present case is designed as a tamper-evident tab and which is linked to the container or, more specifically, to the skirt 5 by linkages that are destroyed when the tamper-evident closure is opened. Preferably, for opening the container, the tamper-evident closure is completely removed or possibly only displaced, in order to enable the lid extension 13 to be engaged for opening the container, hence for releasing the fixing devices between the extension and the container and, in general in a second step, for unlatching the lid from the container, whereby the latching rims 4 and 11 of the container and the lid are disengaged. The tamper-evident closure 6 preferably completely overlaps the lid extension 13 on the outside thereof. The tamper-evident closure 6 is molded to the container skirt 5, if necessary also at a different sub-region of the container. Especially when the tamper-evident closure is designed as a tab such as in the embodiment, the same is integrated in the skirt 5, and when the tamper-evident closure 6 is removed or displaced, an open recess 5*d* is formed at the container skirt through which the extension 13 can be grasped and manipulated with the hand from below. The skirt 5 overlaps and protects the tamper-evident closure on the upper side thereof.

Further, for instance as a result of the above-described design, the skirt forms a boundary for limiting the displacement of the lid extension with regard to the disengagement of the fixing devices between the extensions and the container and/or with regard to the movement of the extension 13 required for unlatching the latching rims 4 and 11. In the container according to the exemplary embodiment, the lid extension can be pivoted in a direction radially outwards and upwards (arrow), while this pivoting movement is limited by the skirt, in the exemplary embodiment by the sub-region of the skirt overlapping the tamper-evident closure on the upper side thereof.

Figure 3:
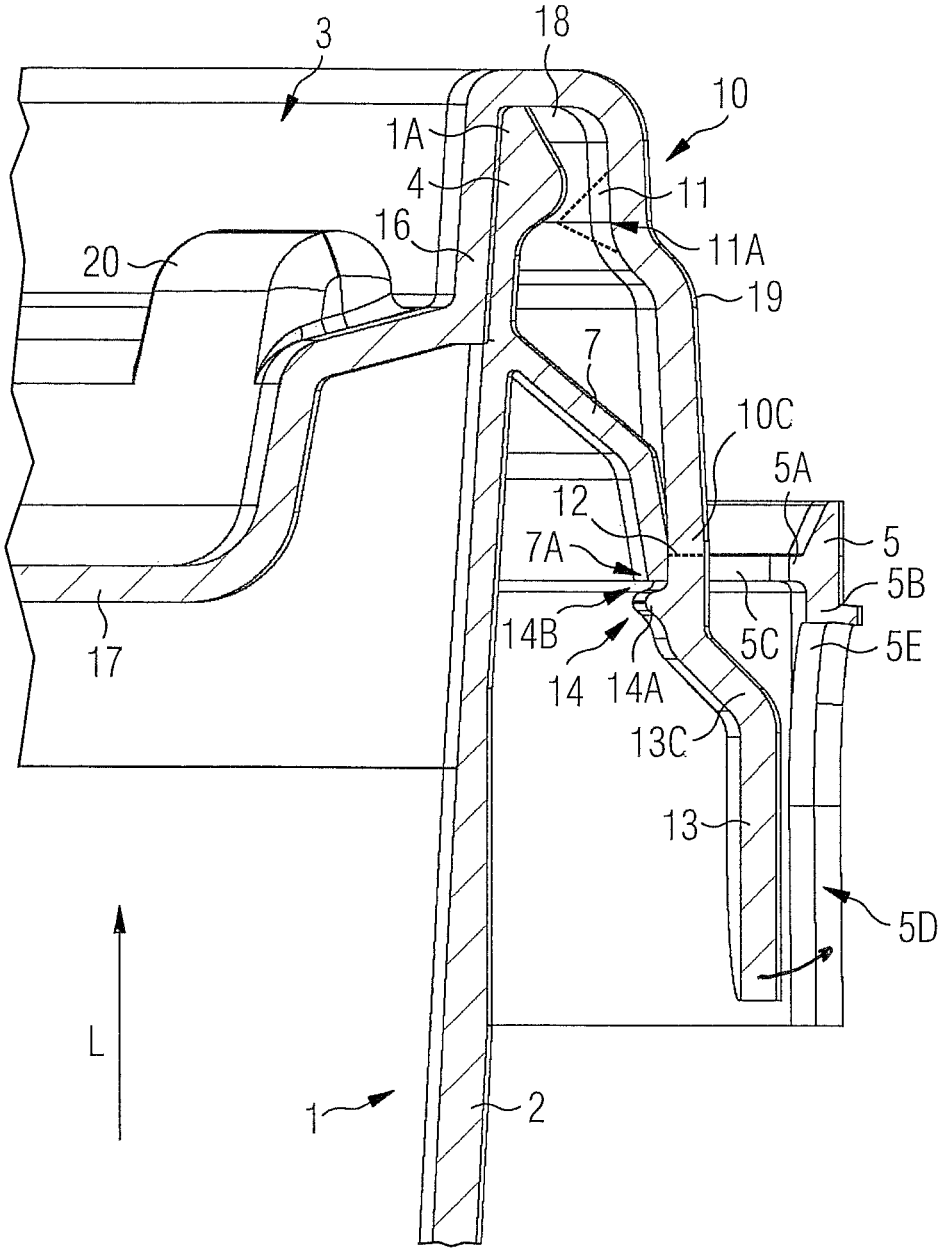
FIG. 3 is a cross-sectional view of the container shown in FIG. 2 in the region of the lid extension.

According to the sectional view in FIG. 3 at the level of the lid extension, the fixing devices of the lid extension 13 are formed as latching devices on the container 1, namely by corresponding latching protrusions 14A and 14B on the extension and on the container. The latching protrusion 14A of the lid extension 13 protrudes radially inwards from said lid extension and towards the container. A collar 7 that is molded to the outside of the container, more precisely the lower edge 7A thereof which is engaged by the latching protrusion 14A from below, serves as a latching protrusion 14B of the container. The lid can be fixed to the container by simply attaching the lid to the container in a latching manner, which simultaneously causes the corresponding fixing devices to become latched to one another. In this case, the collar 7 is designed as a peripheral collar around the entire circumference of the container and also provides for a stiffening of the lateral wall of the container. If necessary, the collar may also comprise several sub-regions spaced from each other in the circumferential direction of the container or may be merely designed as a local protrusion. According to the embodiment, the lid also abuts the collar on the outside thereof in the flange-shaped region 10C, namely preferably around the entire circumference of the container, whereby the lid is stabilized and the fixing devices between the lid extension and the container are relieved of or protected against external forces applied.

The lid extension 13 includes a radially outwardly bulging or protruding region 13C, in this case in the form of a step, which engages under the skirt 5 when the extension is manipulated for releasing the fixing devices 14. In the end region or when the extension is maximally deflected or pivoted towards its open position, the bulging region 13C engages under the skirt 5 at the upper edge 5*e* of the recess 5*d*, which causes the extension and the skirt to become interlinked. This prevents a vertical upward movement of the extension and hence also the corresponding lid part required for opening the lid. This considerably increases child safety. Accordingly, the extension must be brought to an intermediate position between the initial position and the abutting position at the skirt, in order to displace the extension upwards and thus mutually disengage the latching devices for fixing the container to the lid, here the latching rims 4 and 11. In the intermediate pivoting position of the extension, the latching devices 4 and 11 between that lid and the container are already initially disengaged, which makes it easier to displace the latching rims 4 and 11 upwards and continue their disengagement, in order to completely disengage the lid from the container.

Figure 6:
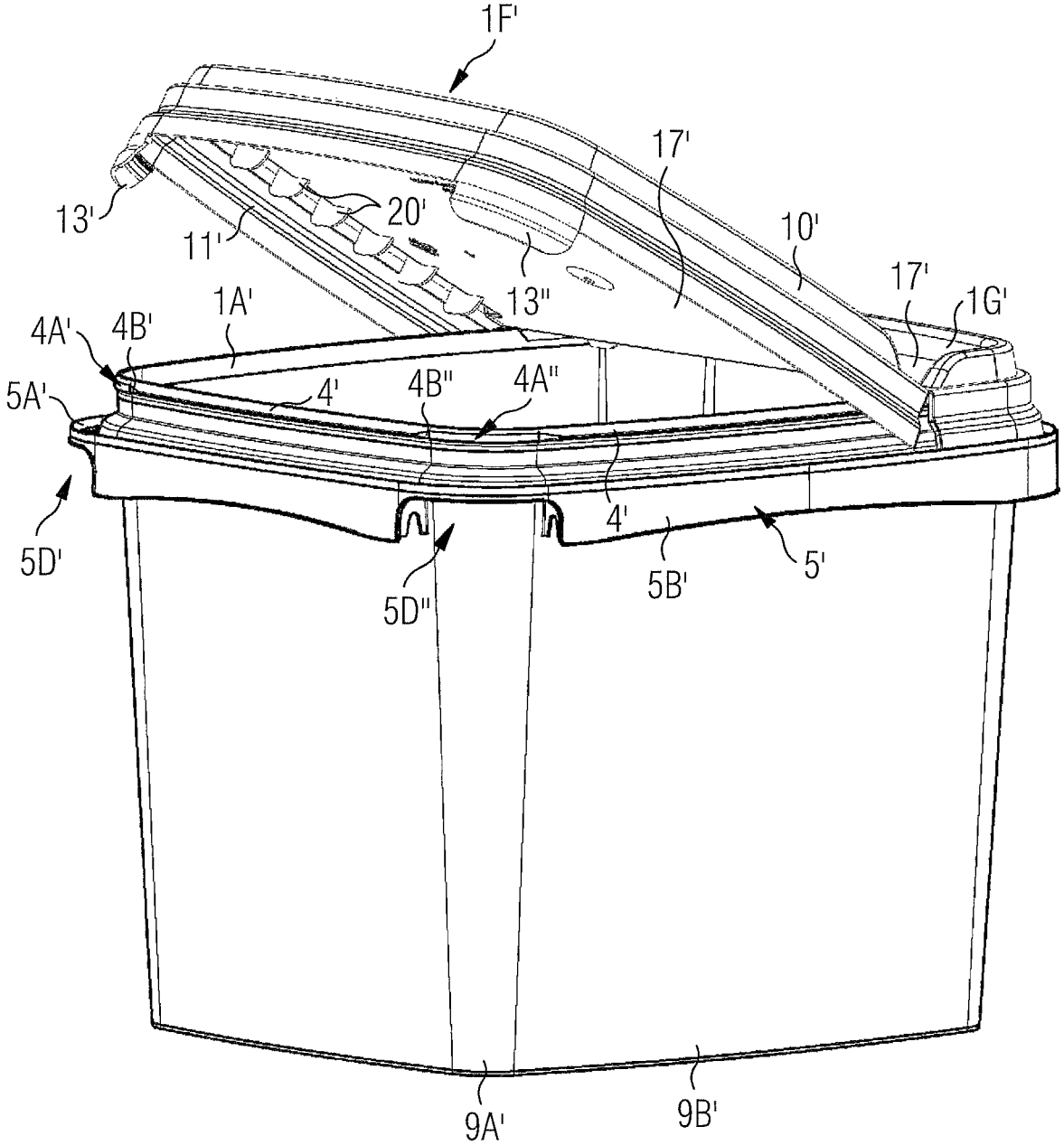
FIG. 6 is a view of the container shown in FIG. 5 with the hinged lid opened.

In order to facilitate opening the container as intended, the latching rim 11 of the lid is weakened at the level of the extension 13 or the fixing devices thereof, more precisely, according to the embodiment (FIG. 3), removed in the region 11A (correspondingly refer to FIG. 6). If necessary, this can be alternatively or additionally given also for the latching rim of the container. The weakened portion or the interruption of the latching rim 11 (slightly) extends beyond the peripheral extent of the lid extension 13, which makes it is easier to open the container by manipulating the extension 13. If necessary, a corresponding transition region is provided at the latching rim.

The fixing devices on the lid extension and on the container are spaced from each other and from the latching rims 4, 11 of the lid and the container in relation to the height of the container. The latching rim of the container is arranged above the collar 7, more precisely at or in the region of the upper edge of the container.

The lid abuts the inner wall of the container with its inner flange 16, which passes into the lid inner surface 17, in a sealing manner. The lid has a peripheral U-shaped channel 18 receiving the upper edge of the container, the extension of the lid being molded to the flange of the channel on the outside thereof. The lid has a step-offset 19 at the outer flange thereof which surrounds the container on the outside thereof, the flange being disposed above the skirt and above the collar when the lid is attached. On the inner surface of the lid sealing the container opening and extending radially to the container edge, the lid comprises several stiffening protrusions 20 distributed over the circumference of the lid.

Figure 2:
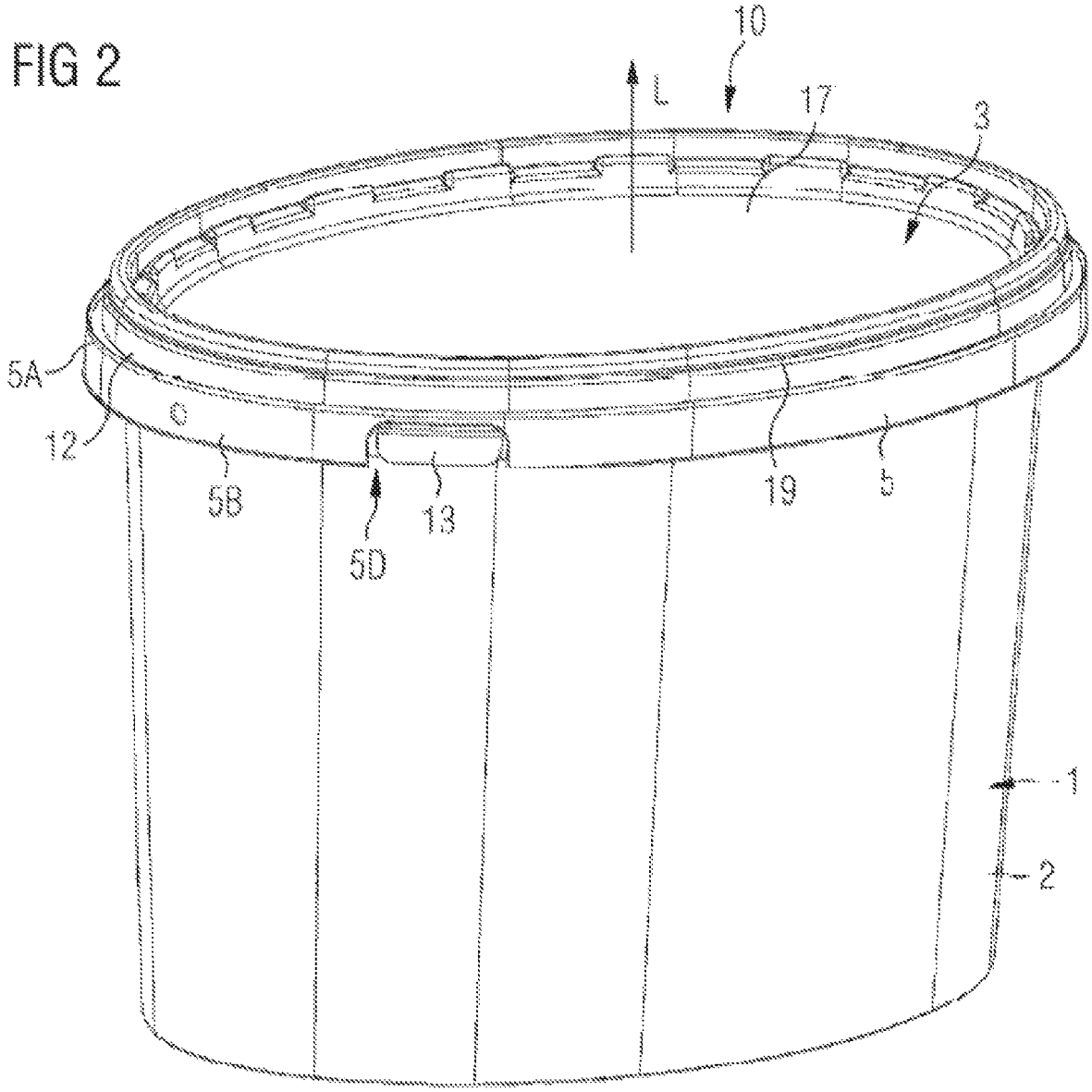
FIG. 2 is a perspective view of the container shown in FIG. 1 with the tamper-evident closure removed.
Figure 4:
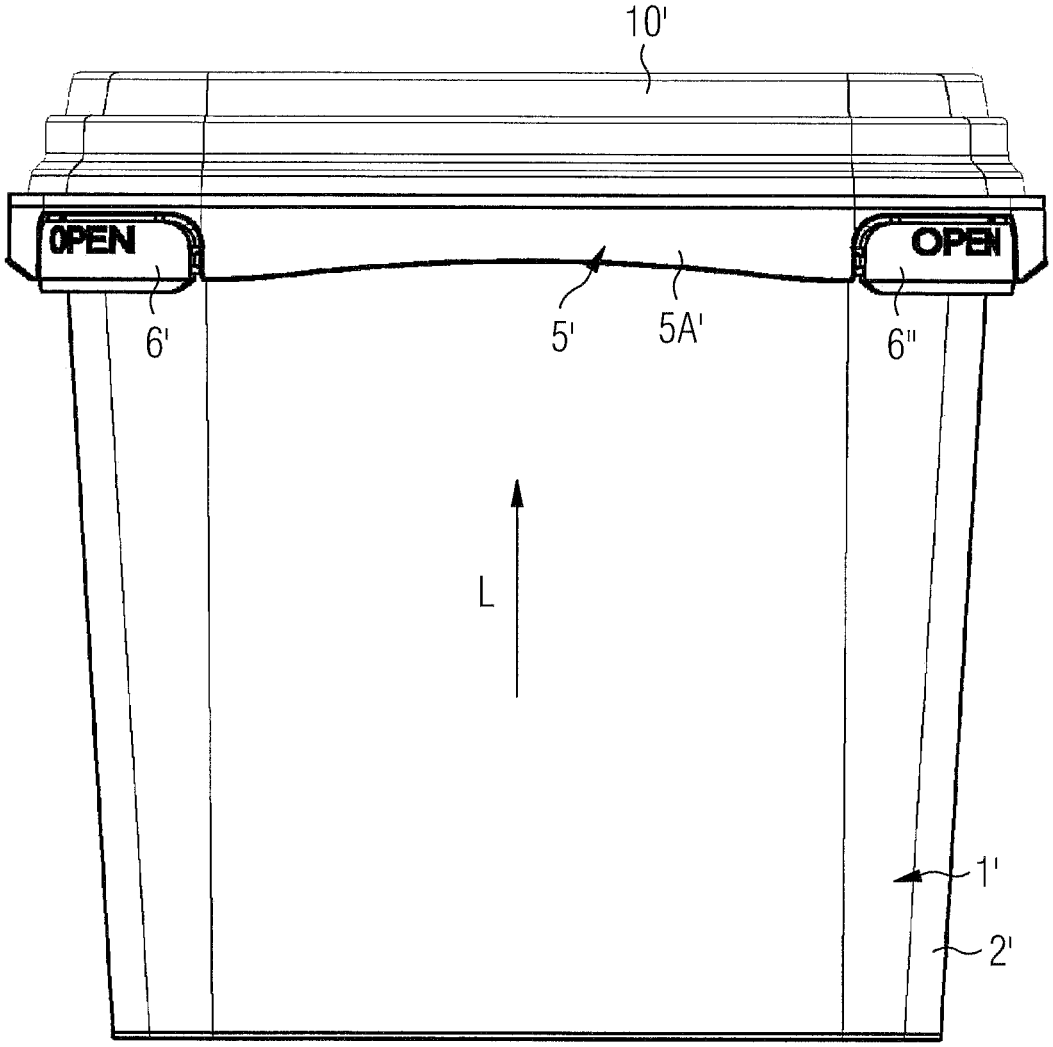
FIG. 4 is a view of the second container having a tamper-evident closure in accordance with the invention.
Figure 5:
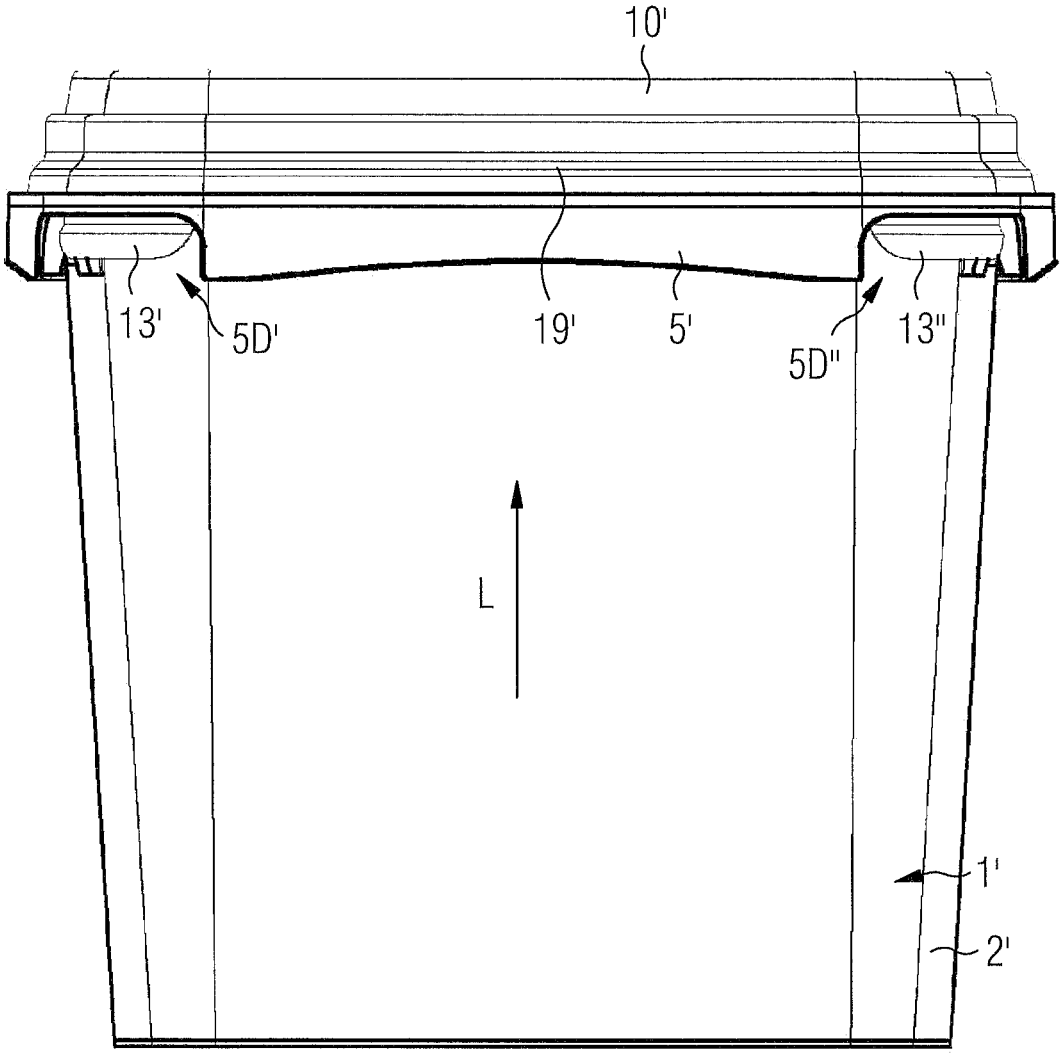
FIG. 5 is a view of the container shown in FIG. 4 with the tamper-evident closure removed and with the lid closed.

The FIGS. 4 to 6 show a modification of a container with lid in accordance with the invention as shown in the FIGS. 1 to 3. Reference is made to the description of these Figures, while the following description merely shows the differences between the modification and the previous embodiment. Features corresponding to the above embodiment are provided with an 'apostrophe' and vice versa. Features described in the context with the following example may be also implemented in a container corresponding to the first embodiment.

The container 1' according to the embodiment is configured as a rectangular container, without being limited thereto. The container 1' comprises two tamper-evident closures 6', 6" and extensions 13', 13", which are each configured corresponding to the exemplary embodiments shown in the FIGS. 1 to 3, except of the difference described in the following. In this case, too, the latching rim 4' of the container 1' (not of the lid) respectively has an interruption 4A' at the level of the extension 13', 13", hence is missing. As an alternative, also a weaker latching connection than in the remaining regions of the peripheral latching rims 4', 11' can be provided. This makes it easier to disengage the lid, in particular by displacing the extensions towards the upper container wall. The interrupted latching rim has a transition region 4B' with an increasing thickness of the latching rim. It will be understood that a corresponding design of the latching rim of the present embodiment can also be implemented in the first embodiment and vice versa.

The arrangement of said two extensions 13', 13" considerably increases child safety of the container, while the container can still be relatively easily opened by an authorized person. In a first variant, the two extensions 13', 13" can be manipulated one after the other, wherein on releasing the respective fixing devices between the extension and the container which may be designed corresponding to the fixing devices of the first embodiment, the respective extension is preferably subsequently moved upwards and towards the upper edge of the container, in order to decouple the latching rims 4', 11' between the container and the lid in the region of the respective extension. After releasing and preferably displacing the first extension, also the second extension can be manipulated, whereby on a vertical upward displacement of the second extension, the lid region between said two extensions and also the lid as a whole disengages from the container. The successive manipulation of said two extensions 13', 13" is enabled in particular by a certain flexibility of the lid. According to another variant, both extensions 13', 13" must be manipulated one after the other, in order to disengage the lid from the container. To this end, the lid presents a higher stiffness than in the first modification. Requiring a simultaneous manipulation of both extensions 13', 13" further increases child safety of the container substantially.

The container 1' has a lateral wall 2' comprising various regions having different radii of curvature, the radii of curvature being small in the corner regions 9A' of the container and comparatively large in the intermediate regions 9B' of the lateral wall. The extensions 13', 13" are arranged in the regions having the smaller radii of curvature and hence an increased stiffness of the lid compared to more flexible regions having larger radii of curvature. This considerably facilitates opening the container by the manipulation as described.

The lid 1' is configured as a hinged lid so that a first sub-region 1F' of the lid is flipped open, in order to open the container, while a second sub-region 1G' of the lid remains fixed in position and latched to the container. Due to this sub-region 1G' of the lid, the lid 10' remains fixed to the container 1' when the container is opened. This makes it much easier to open the container while manipulating the extensions 13', 13". It will be understood that such a hinged lid can be implemented also in a case where only one of the extensions 13' is arranged at the lid.

Figure 7:
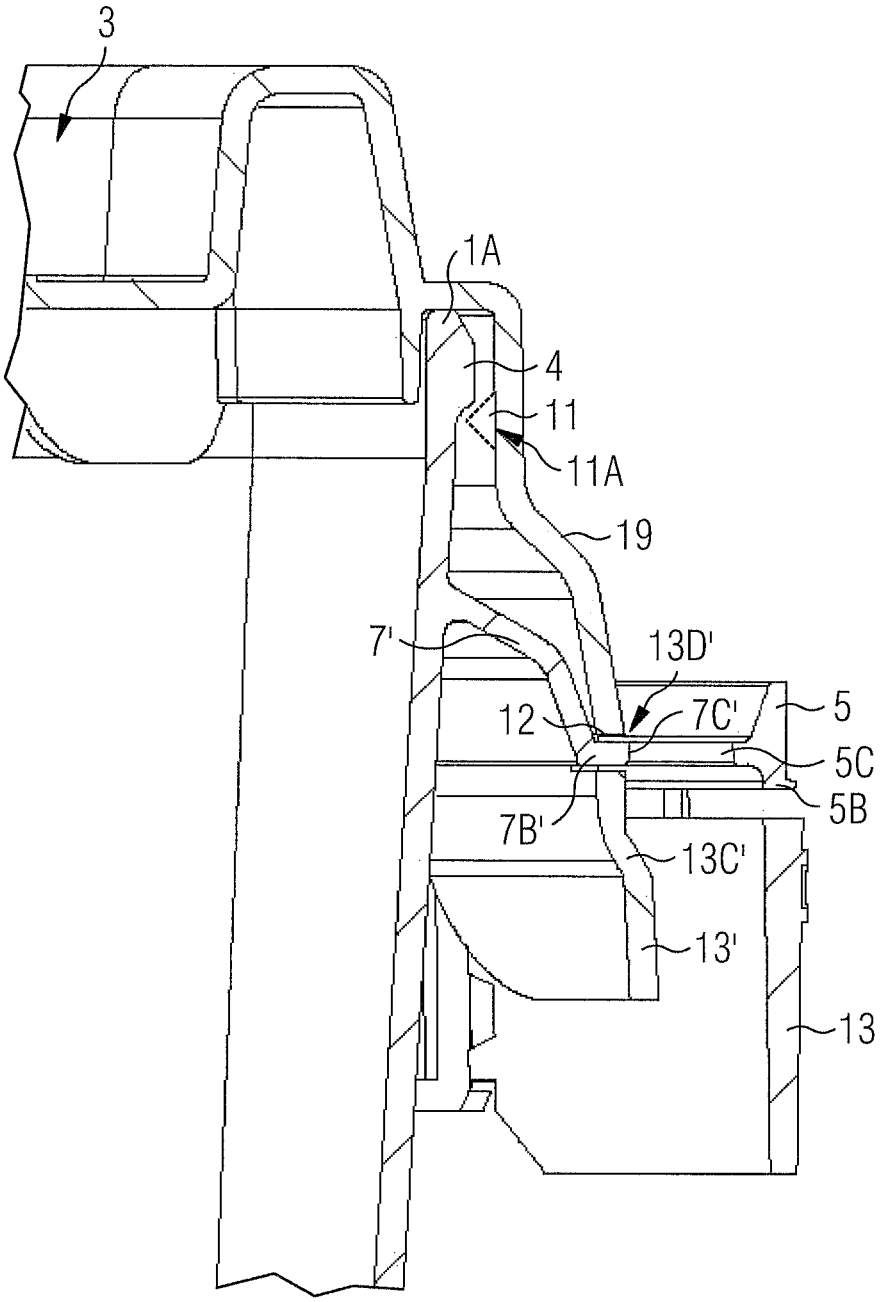
FIG. 7 is a sectional view of an alternative configuration of the lid extension.

FIG. 7 shows an alternative design of the lid extension or the fixing devices for detachably fixing the lid extension to the container. It will be understood that this design may be implemented in all the embodiments of the invention, hence also in the embodiments according to the FIGS. 1 to 6. If the respective lid comprises several extensions, this configuration can be implemented for all the lid extensions or only for a part thereof. For further details of the container and/or the lid, reference is made to the exemplary embodiment of the FIGS. 1 to 6. Where the features are different from those of the FIGS. 1 to 6, the corresponding reference numbers are provided with a quotation mark "'". Moreover, reference is made to the explanatory notes on the reference numbers of the FIGS. 1 to 6.

In the modification according to FIG. 7, the lid extension or the container, here the lid extension 13', have a recess 13'D which is engaged or penetrated by a protrusion 7'B of one of the container and the lid extension as a corresponding fixing device for detachably fixing the lid extension to the container. Here, the protrusion 7'B is molded to the collar 7 of the container. If necessary, the protrusion can also be directly molded to the container lateral wall or to a different sub-region of the container. The recess is here preferably formed as an aperture. The front region 7'C of the protrusion 7'B is thus more easily visible for the user, and the engagement of the protrusion 7B' into the aperture 13'D can be checked more easily. If necessary, the front region of the protrusion 7'B or the protrusion as a whole may have a color different from the color of the lid or the lid extension or can be otherwise marked, whereby the visual detectabily is increased. Further, the boundary of the recess or aperture 13'D can be configured with comparatively sharp edges enabling a secure engagement of the protrusion 7'B into the recess or aperture and thus further increasing child safety.

The features that have been described in the context with the exemplary embodiments may also generally apply within the scope of the present invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A container with a lid, the container comprising:

an upper container edge;

a lateral wall extending around a circumference of the upper container edge;

an upper container opening closed by the lid; and a latching rim, wherein:

the latching rim forms a latching connection with a corresponding latching rim on the lid in a region of the upper container edge;

the latching rim of the container and the latching rim of the lid each extend at least partially around a respective circumference thereof;

the lateral wall of the container comprises a peripheral skirt having a sub-region extending radially outwardly from the lateral wall, and the lid comprises a lower lid rim outside the container, wherein the lid at least comprises a lid extension extending outside the container which extends below the lower lid rim and at least partially penetrates the container skirt, and the lid extension and the container each comprise corresponding fixing devices detachable independently of the latching connection formed by the latching rims of the container and the lid, respectively, wherein the lid extension is at least partially covered on the outside thereof by a tamper-evident closure arranged on the skirt of the container so that the lid extension is accessible for manipulation by removing or displacing the tamper-evident closure.

2. The container according to claim 1, wherein, after removal or displacement of the tamper-evident closure, the skirt at least one of (i) forms a recess open towards the bottom of the container and (ii) overlaps the tamper-evident closure on the upper side thereof.

3. The container according to claim 1, wherein the fixing devices are formed between the lid extension and the container in the form of positive-locking devices or latching devices.

4. The container according to claim 1, wherein the lid extension or the container include a recess that is engaged or penetrated by a protrusion of one of the container and the lid extension as a corresponding fixation means.

5. The container according to claim 1, wherein the fixing device of the lid extension engages a projection or collar molded to the container on the outside thereof and overlapped by the lid.

6. The container according to claim 1, wherein the lid extension has a radially outwardly bulging part engaging an underside of the skirt when the lid extension is displaced.

7. The container according to claim 1, wherein at least one of the latching rim of the container and the lid is designed at least as a weakened latching connection compared to regions of the latching rim of the lid and the container that are circumferentially spaced from the lid extension.

8. The container according to claim 1, wherein at least one of the latching rim of the container and the lid is interrupted adjacent the lid extension.

9. The container according to claim 1, wherein the fixing devices on the lid extension and the container are spaced from the latching rims of the lid and the container in relation to the container height, for fixing the same together in a latching manner.

10. The container according to claim 9, wherein the fixing devices between the lid extension and the container are disposed on a side of the latching rims of the lid and the container around an outer circumference of the upper edge of the container.

11. The container according to claim 1, wherein the latching rims of the lid and the container are arranged between a collar on an exterior of the container and the upper edge of the container, for fixing the lid in a latching manner.

12. The container according to claim 1, wherein the lid comprises at least two lid extensions which each extend below a lower rim of the lid and which are spaced from each other in a circumferential direction of the container.

13. The container according to claim 12, wherein the lid comprises several successively manipulatable lid extensions for detaching the lid from the container.

14. The container according to claim 12, wherein the lid comprises several simultaneously manipulatable lid extensions for detaching the lid from the container.

15. The container according to claim 1, wherein the lateral wall of the container comprises regions having large and small radii of curvature and that at least one of the lid extensions is arranged at regions of the lateral wall having a small radius of curvature.

16. The container according to claim 1, wherein the lid includes at least two lid extensions arranged at adjacent regions of the container lateral wall having a small radius of curvature, wherein a lateral wall region having the relatively larger radius of curvature is arranged between the lateral wall regions having the smaller radius of curvature.

17. The container according to claim 1, wherein the lid is a hinged lid.

18. The container according to claim 1, wherein the lid extension is designed as to be deformable in a reversible manner so that the fixing devices between the lid extension and the container can be released under a reversible deformation of the lid extension, wherein the lid extension is permanently attached to the lid, wherein the fixing devices between the lid extension and the container can be again fixed to one another after the initial opening of the container and the container can be opened and closed several times, wherein the latching rim of the container and latching rim of the lid can be unlatched only during an ongoing unlatching operation of the fixing devices between the lid extension and the container, and wherein a lower end portion of the lid extension has a free end portion, and the free end portion of the lid extension is adapted to be manually operated by manual engagement and is adapted to be manually pivoted to release the fixing device between the lid extension and the container.

19. The container according to claim 1, wherein the lid extension is designed as to be deformable in a reversible manner so that the fixing devices between the lid extension and the container can be released under a reversible deformation of the lid extension, wherein the lid extension is permanently attached to the lid, and wherein the fixing devices between the lid extension and the container can be again fixed to one another after the initial opening of the container and the container can be opened and closed several times, and wherein the lid comprises two lid extensions, and both lid extensions are designed that they require simultaneous manual engagement to open the lid.

20. A container with a lid, the container comprising:

an upper container edge;

a lateral wall extending around a circumference of the upper container edge;

an upper container opening closed by the lid; and a latching rim, wherein:

the latching rim forms a latching connection with a corresponding latching rim on the lid in a region of the upper container edge;

the latching rim of the container and the latching rim of the lid each extend at least partially around a respective circumference thereof;

the lateral wall of the container comprises a peripheral skirt having a sub-region extending radially outwardly from the lateral wall, and the lid comprises a lower lid rim outside the container, wherein the lid at least comprises a lid extension extending outside the container which extends below the lower lid rim and at least partially penetrates the container skirt, and the lid extension and the container each comprise corresponding fixing devices detachable independently of the latching connection formed by the latching rims of the container and the lid, respectively, wherein the lid extension is designed as to be deformable in a reversible manner so that the fixing devices between the lid extension and the container can be released under a reversible deformation of the lid extension, wherein the lid extension is permanently attached to the lid, and wherein the fixing devices between the lid extension and the container can be again fixed to one another after the initial opening of the container and the container can be opened and closed several times, wherein the latching rim of the container and the latching rim of the lid can be unlatched only during an ongoing unlatching operation of the fixing devices between the lid extension and the container, and wherein the lid extension has a radially outwardly bulging part engaging an underside of the skirt when the lid extension is sufficiently displaced radially outwardly, and wherein the radially outwardly bulging part is arranged at the lid extension at an opposite side of the fixing devices cooperating between the lid extension and the container, and said radially outwardly bulging part is designed to hook with the skirt when displaced radially outwardly beyond an intermediate pivoting position, the intermediate pivoting position being a pivoting position of the lid extension wherein the fixing devices are unlocked and the radially outwardly bulging part is not hooked with the skirt, and wherein the radially outwardly bulging part, when hooked with the skirt, prevents the lid from an upward displacement, so that the lid extension must be arranged in the intermediate pivoting position to enable the lid to be moved upwardly and to be detached from the container.

21. The container according to claim 18, wherein the free end portion of the lid extension is at least partially covered on the outside by a tamper-evident closure arranged on the skirt, and only upon removal or displacement of the tamper-evident closure, the free end portion of the lid extension either extends below the lower skirt edge or extends into a recess of the skirt, so that the free end portion of the lid extension is accessible for manual pivoting only upon removal or displacement of the tamper-evident closure.

22. The container according to claim 18, wherein at least one of the latching rims of the container and of the lid is circumferentially aligned with the lid extension and is designed as a weakened latching connection compared to regions of the latching rims of the lid and of the container that are circumferentially spaced from the lid extension.

* * * * *